US007347583B2

(12) United States Patent
Britt

(10) Patent No.: US 7,347,583 B2
(45) Date of Patent: Mar. 25, 2008

(54) AUTOMATICALLY ACTIVATED FLASHLIGHT AND HOLSTER

(76) Inventor: Boyd Britt, 809 S. Santa Fe St., Visalia, CA (US) 93292

( * ) Notice: Subject to any disclaimer, the term of this patent is extended or adjusted under 35 U.S.C. 154(b) by 119 days.

(21) Appl. No.: 11/224,833

(22) Filed: Sep. 12, 2005

(65) Prior Publication Data

US 2007/0058364 A1 Mar. 15, 2007

(51) Int. Cl.
*F21L 4/00* (2006.01)
*H01H 9/00* (2006.01)

(52) U.S. Cl. ..... 362/206; 362/204; 335/205

(58) Field of Classification Search ..... 362/204–206; 335/205

See application file for complete search history.

(56) References Cited

U.S. PATENT DOCUMENTS

| | | | | |
|---|---|---|---|---|
| 2,500,257 | A | 3/1950 | Mahan | 224/5 |
| 3,239,658 | A * | 3/1966 | Castaldo | 362/155 |
| 3,800,134 | A * | 3/1974 | Castaldo | 362/155 |
| 4,214,185 | A * | 7/1980 | Breeze | 315/86 |
| 4,274,070 | A * | 6/1981 | Thiene | 335/205 |
| 4,750,095 | A * | 6/1988 | Huang | 362/190 |
| 4,905,130 | A * | 2/1990 | Huang | 362/203 |
| 5,197,741 | A * | 3/1993 | Wu | 273/237 |
| 5,413,223 | A * | 5/1995 | Kang | 206/573 |
| 5,440,465 | A | 8/1995 | Hasness | 362/191 |
| 5,540,368 | A | 7/1996 | Oliva | 224/271 |
| 5,593,074 | A | 1/1997 | Matthews | 224/251 |
| 5,893,629 | A | 4/1999 | Gubernick | 362/186 |
| 5,975,713 | A * | 11/1999 | Brothers | 362/155 |
| D503,039 | S | 3/2005 | Cook et al. | D3/229 |
| 7,033,040 | B2 * | 4/2006 | Spahr et al. | 362/155 |
| 7,033,042 | B2 * | 4/2006 | Lim | 362/202 |
| 2004/0246712 | A1 | 12/2004 | Endo | 362/190 |
| 2005/0047118 | A1 * | 3/2005 | Spahr et al. | 362/109 |
| 2007/0008719 | A1 * | 1/2007 | Hill | 362/198 |

FOREIGN PATENT DOCUMENTS

| | | | |
|---|---|---|---|
| GB | 002277371 A | 10/1994 | 362/257 |

* cited by examiner

*Primary Examiner*—Ismael Negron
(74) *Attorney, Agent, or Firm*—Kenneth L. Green; Edgar W. Averill, Jr.

(57) ABSTRACT

A flashlight and holder cooperate to automatically turn the flashlight on when the flashlight is removed from the holder and turn the flashlight off when the flashlight is returned to the holder. The flashlight includes a bottom cap with a magnetically actuated switch. The holder includes a magnet which cooperates with the switch to turn off the flashlight. The magnet also provides some degree of attraction for retaining the flashlight in the holder. The holder may be a stationary holder for holding a flashlight in a home or workplace, or may be a holster.

12 Claims, 3 Drawing Sheets

AUTOMATICALLY ACTIVATED FLASHLIGHT AND HOLSTER

BACKGROUND OF THE INVENTION

The present invention relates to flashlights and in particular to a flashlight which turns on automatically when removed from a cooperating flashlight holder.

Flashlights are found in almost every shop and household. Flashlights are often used in awkward or confined spaces and/or in situations where one handed use is required. In these instances, it is often difficult to turn the flashlight on.

BRIEF SUMMARY OF THE INVENTION

The present invention addresses the above and other needs by providing a flashlight and holder which cooperate to automatically turn the flashlight on when the flashlight is removed from the holder and turn the flashlight off when the flashlight is returned to the holder. The flashlight includes a bottom cap with a magnetically actuated switch. The holder includes a magnet which cooperates with the switch to turn off the flashlight. The magnet also provides some degree of attraction for retaining the flashlight in the holder. The holder may be a stationary holder for holding a flashlight in a home or workplace, or may be a holster.

In accordance with one aspect of the invention, there is provided a flashlight and flashlight holder. The flashlight comprises a flashlight body portion having a battery cavity, a flashlight head portion above the flashlight body portion and including a light source, and a flashlight bottom portion below the flashlight body portion. A battery spring in the bottom portion exerts holding force against a battery in the battery cavity and makes electrical contact with the battery. An on/off contact resides in the flashlight bottom portion and cooperates with a contact spring configured to bias the on/off contact into an ON position providing electrical contact between the bottom portion and the battery spring, thereby turning on the flashlight. The flashlight holder includes a magnet which cooperates with the on/off contact to bias the contact to an OFF position when the flashlight resides in the holder, thereby turning off the flashlight. The holder may further include a charging circuit for recharging the battery.

In accordance with another aspect of the invention, there is provided a flashlight and flashlight holster. The flashlight comprises a flashlight body portion having a battery cavity, a flashlight head portion above the flashlight body portion and including a light source, and a flashlight bottom portion below the flashlight body portion. A battery spring in the bottom portion exerts a holding force against a battery in the battery cavity and makes electrical contact with the battery. An on/off contact resides in the flashlight bottom portion and a contact spring in the bottom portion is configured to bias the on/off contact into an ON position providing electrical contact between the bottom portion and the battery spring, thereby turning on the flashlight. The flashlight holster includes a holster bottom portion and a magnet residing in the holster bottom portion. The magnet cooperates with the on/off contact to bias the contact to an OFF position when the flashlight resides in the holster, thereby turning off the flashlight.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
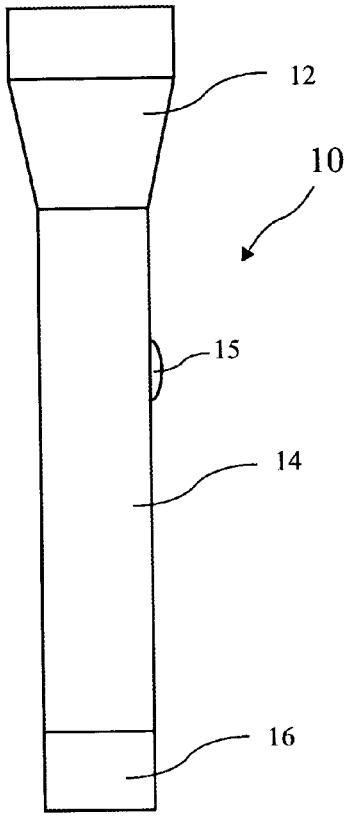
FIG. 1 is flashlight according to the present invention.

A flashlight 10 according to the present invention is shown in FIG. 1. The flashlight 10 includes a head portion 12, a body portion 14, and a bottom portion 16. A light source, preferably a light bulb or a Light Emitting Diode (LED) or the like resides in the head portion 12 and provides a beam of light from the flashlight 10. The body portion 14 includes a battery cavity for carrying one or more batteries for providing power to the light source, and may include a manual switch 15 for manually turning the flashlight 10 on and off. The manual switch 15 may include three positions, a first switch position in which the flashlight 10 is always on, a second switch position in which the flashlight 10 is turned on and off by cooperation with a holder, and a third switch position in which the flashlight 10 is always off.

The flashlight 10 includes a second (or automatic) switch according to the present invention for automatically turning the flashlight 10 on when the flashlight 10 is removed from a holder, and for automatically turning the flashlight 10 off when the flashlight is returned to the holder. Advantageously, the second switch operates through the cooperation of a contact residing in the flashlight 10 and made from magnetic material (i.e., material which is attracted to or repulsed by a magnet), and a magnet in the holder. As a result, there is no need for openings in the flashlight 10 to allow moisture or the like to enter and damage the flashlight, and there is no need for a protruding switch which may accidentally be turned on or off, or caught on clothing or other objects.

Figure 2:
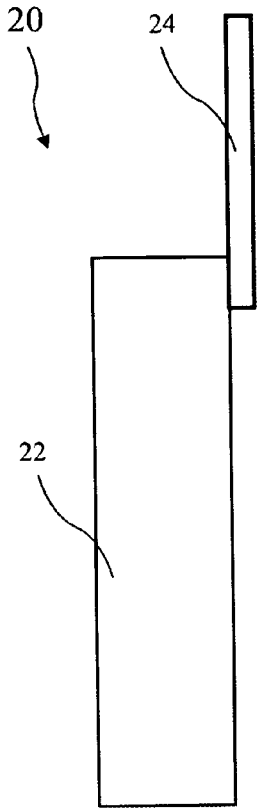
FIG. 2 is a holster according to the present invention for carrying the flashlight.
Figure 3:
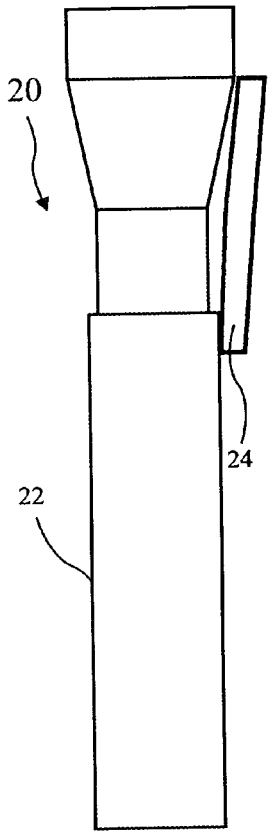
FIG. 3 depicts the flashlight in the holster.

A flashlight holder comprising a holster 20 according to the present invention is shown in FIG. 2. The holster 20 includes a carrier portion 22 for carrying the flashlight 10, and a belt loop 24 for carrying the holster 20 on a belt. The flashlight 10 is shown residing in the holster 20 in FIG. 3.

Figure 4:
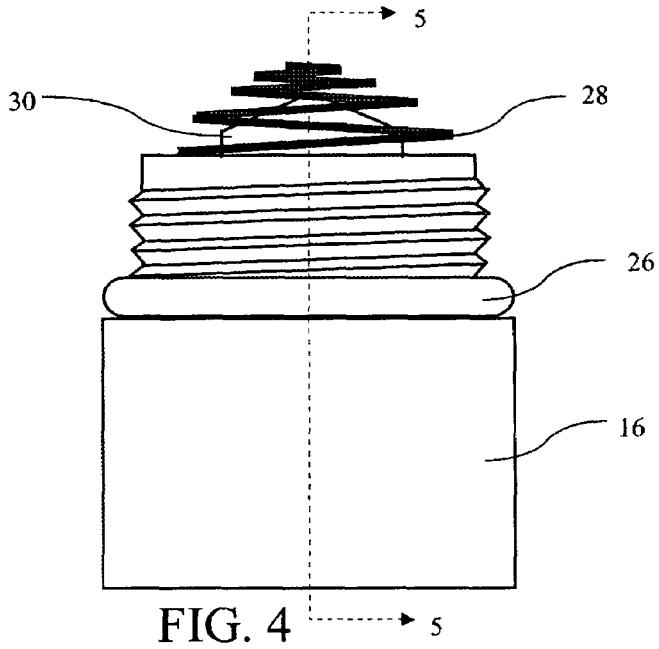
FIG. 4 is a bottom portion of the flashlight.

A detailed view of the bottom portion 16 is shown in FIG. 4. The bottom portion 16 includes a battery spring 28 for holding the battery in position in the flashlight body portion 14 and making an electrical connection with the battery, and an on/off contact 30 for making an electrical connection between the bottom portion 16 and the battery spring 28. An o-ring 26 seals the bottom portion 16 to the body portion 14.

Figure 5C:
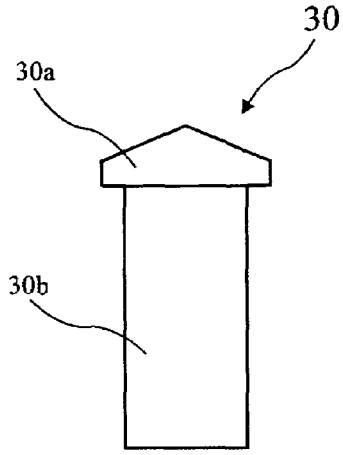
FIG. 5C is a detailed view of the on/off contact according to the present invention.
Figure 5A:
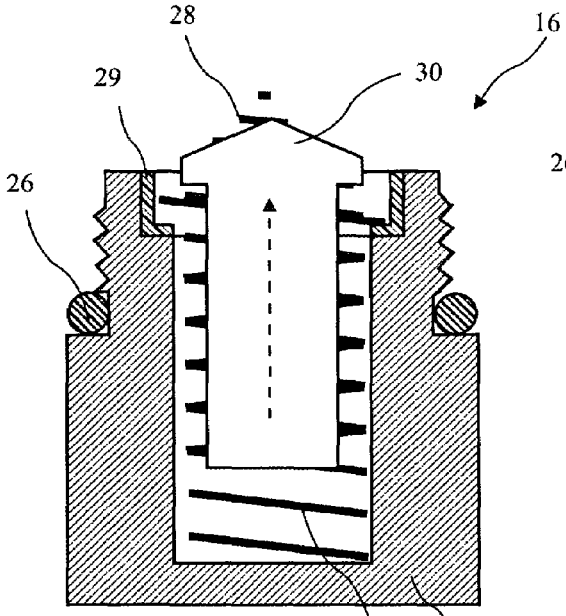
FIG. 5A is a cross-sectional view of the bottom portion taken along line 5-5 of FIG. 4 showing an on/off contact biased into an ON position by a contact spring.

A cross-sectional view of the bottom portion 16 taken along line 5-5 of FIG. 4 is shown in FIG. 5A. The battery spring 28 is seated in an insulator 29, whereby the battery spring 28 is electrically insulated from a bottom portion housing 34. In another embodiment, a coating is provided on a bottom portion of the battery spring 28 to electrically insulate the battery spring 28 from the bottom portion housing 34, and any magnetically switched flashlight including any insulator for electrically insulating the battery spring 28 from the bottom portion housing 34 is intended to come within the scope of the present invention. The on/off contact 30 is shown biased upward into an ON position by a contact spring 32, wherein the on/off contact 30 makes electrical contact with the battery spring 28. The on/off contact 30 is also in electrical contact with the bottom portion housing 34, for example, through the contact spring 32, thereby forming an electrical connection between the bottom portion housing 34 and the on/off contact 30.

In another embodiment a leaf spring or the like may reside under the on/off contact 30 to bias the on/off contact into an ON position and to provide an electrical contact between the bottom portion housing 34 and the on/off contact 30. Further, the upward biasing of the on/off contact 30 into the ON position may be provided by a spring, and the electrical connection between the bottom portion housing 34 and the on/off contact 30 may be provided by a lead. The on/off contact 30 may alternatively be a hollow on/off contact and a second contact spring may reside within the hollow on/off contact to bias the on/off contact upward into the ON position. Within the present application, upward or up corresponds to toward the head section 12, and downward or down corresponds to toward the bottom section 16.

Figure 5B:
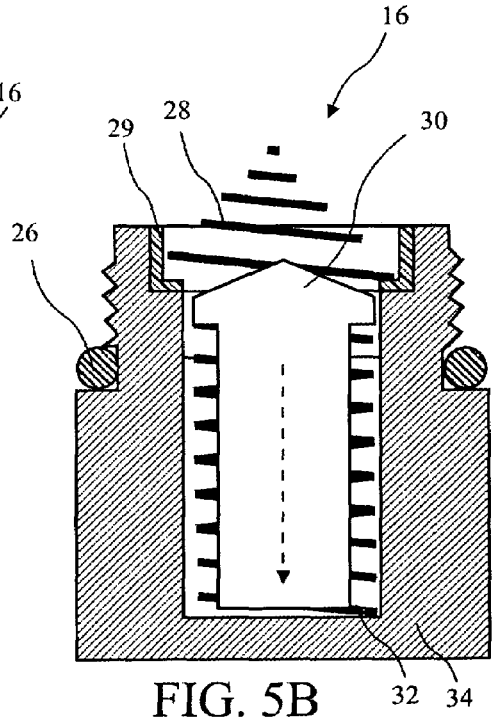
FIG. 5B is a cross-sectional view of the bottom portion taken along line 5-5 of FIG. 4 showing the on/off contact biased into an OFF position by a magnet residing in the holster.

A cross-sectional view of the bottom portion taken along line 5-5 of FIG. 4 showing the on/off contact 30 biased into an OFF (or downward) position is shown in FIG. 5B. The on/off contact 30 is pulled downward by a magnet 36 residing in the holster 20 (see FIG. 7), or in the table top holder 38 (see FIG. 9). When the on/off contact 30 is pulled downward into the OFF position, the on/off contact 30 no longer makes electrical contact with the battery spring 28 and thereby turns off the flashlight 10.

A detailed view of the on/off contact 30*a* is shown in FIG. 5C. The on/off contact 30 may be a single conductive magnetic material, or may comprise a conductive tip 30*a* and a magnetic post 30*b* preferably made from a ferro magnetic material or the like.

Figure 6:
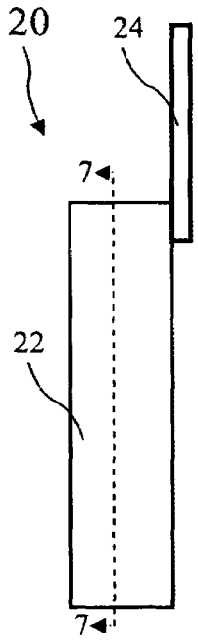
FIG. 6 is a side view of the holster
Figure 7:
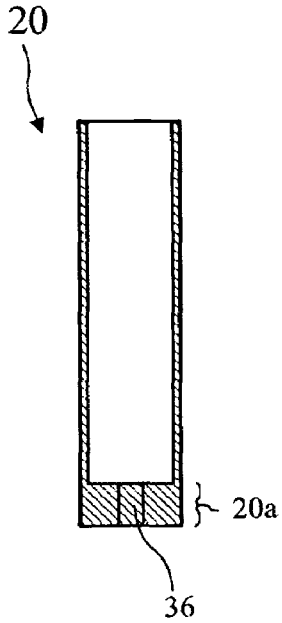
FIG. 7 is a cross-sectional view of the holster taken along line 7-7 of FIG. 6.

A side view of the holster 20 is shown in FIG. 6, and a cross-sectional view of the holster 20 taken along line 7-7 of FIG. 6 is shown in FIG. 7. The magnet 36 resides in a holster bottom portion 20*a* of the holder 20 approximately centered horizontally. The magnet 36 both switches the flashlight 10 off when the flashlight 10 resides in the holster 20 and also provides some degree of attraction for retaining the flashlight 10 in the holster 20. The holster 20 is preferably made from a flexible material and more preferably made from a nylon material such as ballistic nylon.

Figure 8:
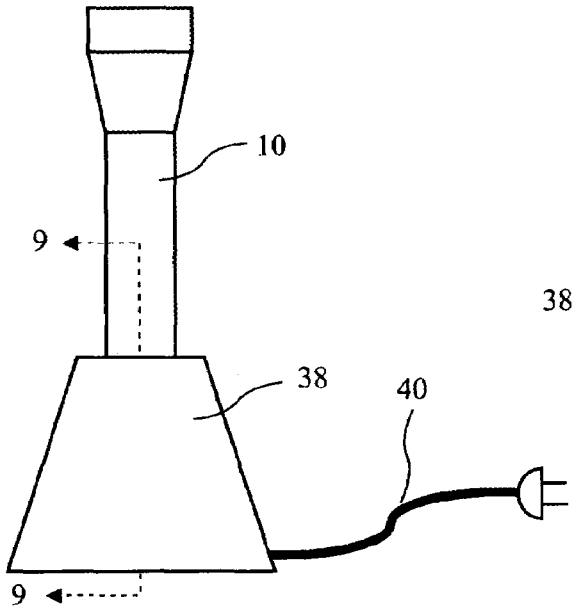
FIG. 8 is a side of the flashlight residing in a table top holder according to the present invention.

A side of the flashlight 10 residing in a table top holder 38 according to the present invention is shown in FIG. 8. The table top holder 38 may be used on any approximately horizontal surface, for example, on a table, on a desk, on a counter top, on a work bench, inside a drawer, inside a cupboard, etc. The table top holder 38 may further include a cord 40 for a recharger for the flashlight 10.

Figure 9:
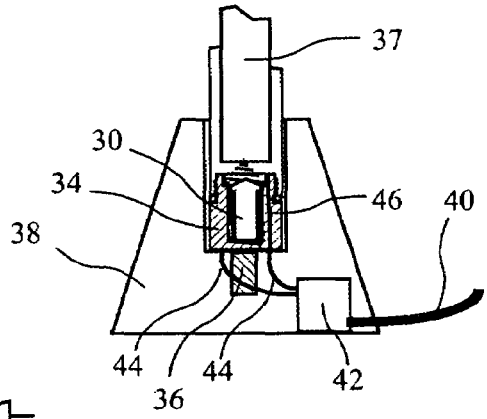
FIG. 9 is a cross-sectional view of the flashlight and holder taken along line 9-9 of FIG. 8.

A cross-sectional view of the flashlight 10 and table top holder 38 taken along line 9-9 of FIG. 8 is shown in FIG. 9. The on/off contact 30 is held in a down (or OFF) position by the magnet 36. A battery charger 42 receives power through the cord 40 and provides charging current to the battery 37 through first leads 44. One of the first leads 44 makes an electrical connection with the bottom portion housing 34, and the other lead 44 makes contact with a second lead 46 which is electrically connected to the battery spring 28 (see FIG. 4). Thus, when the flashlight 10 resides in the table top holder 38, the flashlight 10 is turned off, and may be charging. A low cost holder without a battery charger 42 is also useful when keeping the battery 37 charged is not important.

Various embodiments of a magnetically operated switch for a flashlight are feasible, and any flashlight having a magnetically operating on/off contact for turning a flashlight on upon removing from a holder, and off upon returning to a holder, is intended to come within the scope of the present invention.

While the invention herein disclosed has been described by means of specific embodiments and applications thereof, numerous modifications and variations could be made thereto by those skilled in the art without departing from the scope of the invention set forth in the claims.

I claim:

1. A Flashlight and holder comprising:

a flashlight body portion having a battery cavity;

a flashlight head portion above the flashlight body portion and including a light source;

a flashlight bottom portion below the flashlight body portion said flashlight bottom portion supporting a battery spring which is electrically conductive but which is electrically insulated from the flashlight bottom portion;

an on/off contact residing in the flashlight bottom portion and normally biased to an ON position by a contact spring which provides an electrical connection between the bottom portion housing and the on/off contact and which urges the on/off contact into electrical contact with the battery spring;

a flashlight holder including a magnet, wherein the magnet cooperates with the on/off contact to bias the contact to an OFF position when the flashlight resides in the holder.

2. The flashlight and holder of claim 1, wherein the flashlight holder is a holster.

3. The flashlight and holder of claim 1, wherein:

the bottom portion housing includes a substantially cylindrical contact cavity;

the on/off contact includes a substantially cylindrical magnetic post and a conductive tip for making electrical contact with the battery spring; and the contact spring and the post portion reside inside the contact cavity.

4. The flashlight and holder of claim 3, wherein the contact spring resides around the magnetic post and exerts upward force against the conductive tip to urge the conductive tip into electrical contact with the battery spring.

5. The flashlight and holder of claim 1, wherein the bottom portion housing is made from a non magnetic material.

6. The flashlight and holder of claim 5, wherein the bottom portion housing is made from aluminum.

7. The flashlight and holder of claim 1, wherein the flashlight holder is a table top holder.

8. The flashlight and holder of claim 7, wherein the table top holder includes a battery recharger configured to recharge at least one battery in the flashlight.

9. A flashlight and holder comprising:

a flashlight body portion having a battery cavity;

a flashlight head portion above the flashlight body portion and including a light source;

a flashlight bottom portion below the flashlight body portion;

a battery spring in the bottom portion for exerting holding force against at least one battery in the battery cavity and making electrical contact with the at least one battery in the battery cavity said battery spring being electrically insulated from said body portion;

an on/off contact residing in the flashlight bottom portion;

a contact spring in the bottom portion configured to bias the on/off contact into electrical contact between the bottom portion and the battery spring;

a flashlight holder including a magnet, wherein the magnet cooperates with the on/off contact to bias the contact to an OFF position when the flashlight resides in the holder.

10. The flashlight and holder of claim 9, wherein:

the bottom portion includes a bottom portion housing;

the battery spring is insulated from the bottom portion housing; and the contact spring urges the on/off contact into electrical contact between the bottom portion housing and the battery spring.

11. The flashlight and holder of claim 10, wherein:

the bottom portion housing includes a substantially cylindrical contact cavity;

the on/off contact includes a magnetic post and a conductive tip for making electrical contact with the battery spring; and the contact spring resides inside the contact cavity and around the magnetic post and exerts upward force against the conductive tip to urge the conductive tip into electrical contact between the bottom portion housing and the battery spring.

12. The flashlight and holder of claim 10, wherein the contact spring provides an electrical connection between the bottom portion housing and the one/off contact.

* * * * *